United States Patent [19]

Hopkins

[11] Patent Number: 4,475,251

[45] Date of Patent: Oct. 9, 1984

[54] WEARABLE PURSE

[76] Inventor: Patricia A. Hopkins, Rte. 1, Box 7, Philomath, Oreg. 97370

[21] Appl. No.: 441,620

[22] Filed: Dec. 28, 1982

[51] Int. Cl.[3] ..... A41D 1/00; A41D 3/02

[52] U.S. Cl. ..... 2/94; 2/85

[58] Field of Search ..... 2/85, 94, 93, 88, 108

[56] References Cited

U.S. PATENT DOCUMENTS 2,146,243 2/1939 Aug ..... 2/85

4,404,687 9/1983 Hager ..... 2/94

*Primary Examiner*—Doris L. Troutman

[57] ABSTRACT

A garment capable of being folded and converted to a purse. The garment contains pockets of various sizes and shapes designed specifically to carry items usually carried in a purse. The pockets are on the outside and in the lining portion of the garment and are so arranged that the garment is not distorted by items carried within said pockets. Zippers and VELCRO are used as closures for some of the pockets.

A rectangular portion affixed to the back portion of the lining containing gussets with separating type zippers and strips of VELCRO converts to a conventional purse with the remainder of the garment contained within. The pockets of the garment are so arranged that they are accessible while the garment is contained within the conventional purse portion.

A method for folding the garment and converting it to a conventional purse is also disclosed.

10 Claims, 11 Drawing Figures

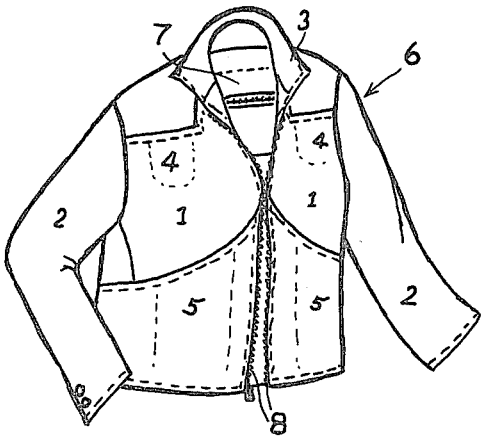
FIG. 1.
FIG. 2.
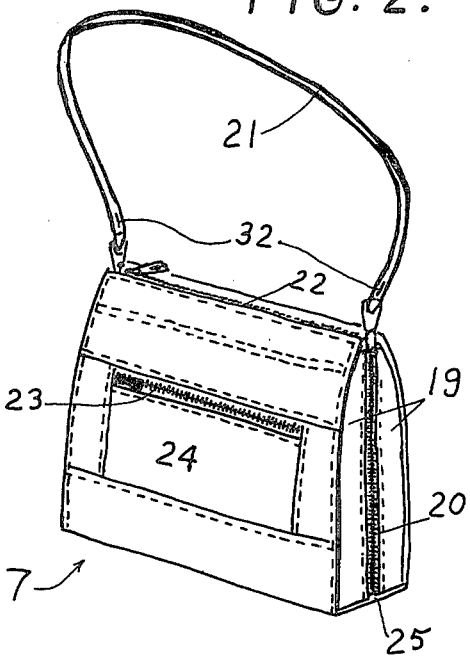
FIG. 3.
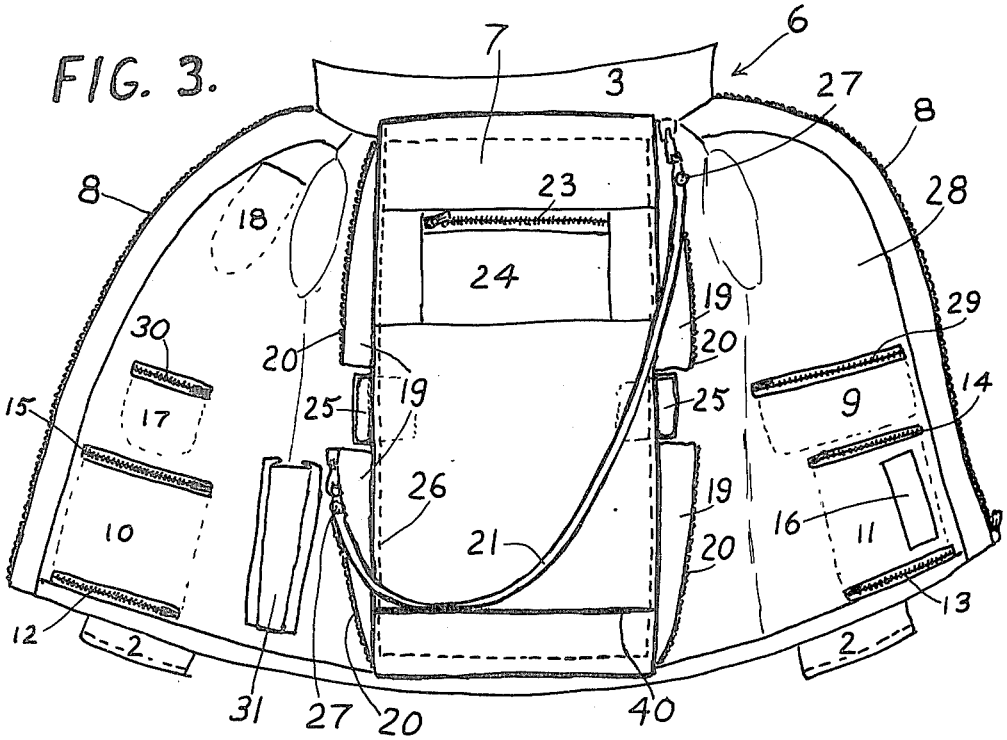

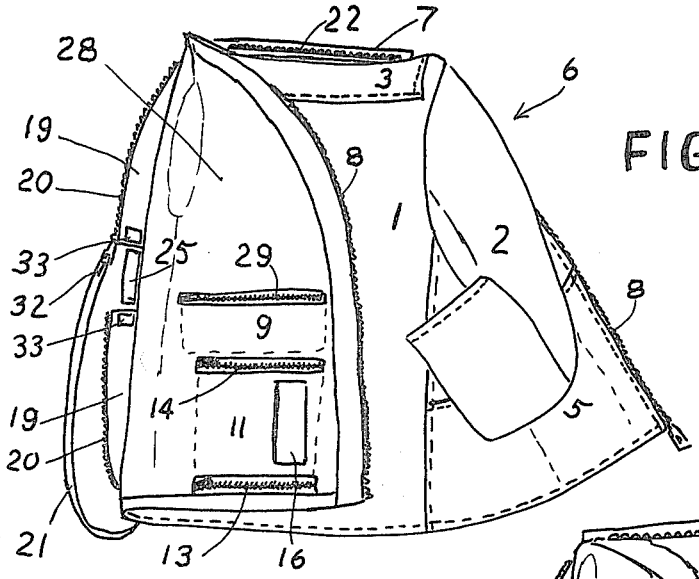
FIG. 4.
FIG. 5.
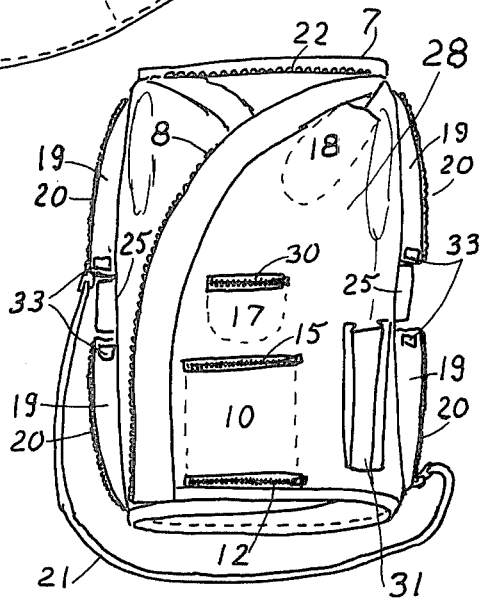
FIG. 6.
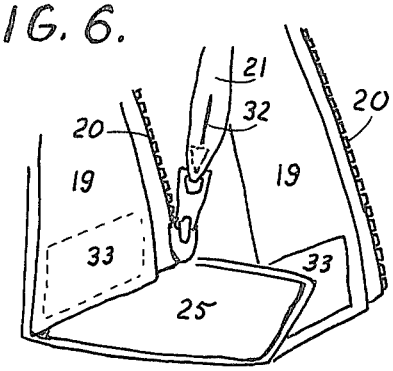
FIG. 7.
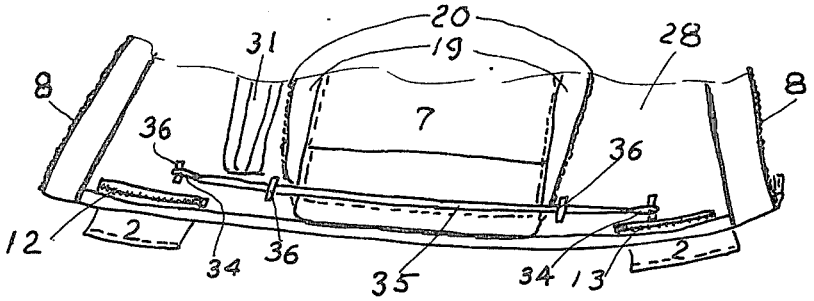

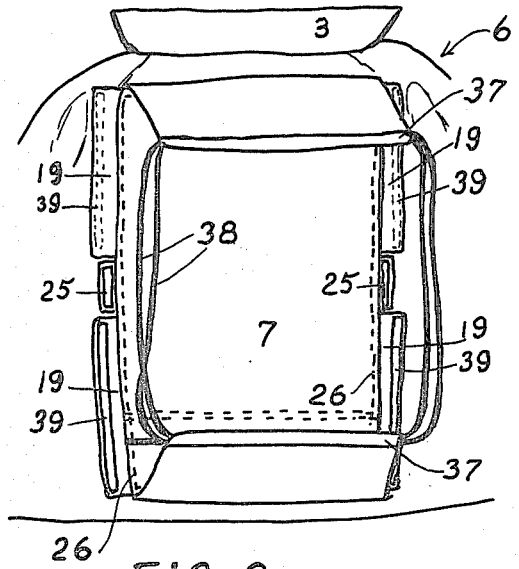
FIG. 8.
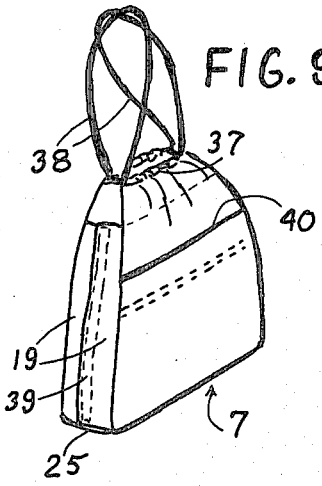
FIG. 9.
FIG. 10.
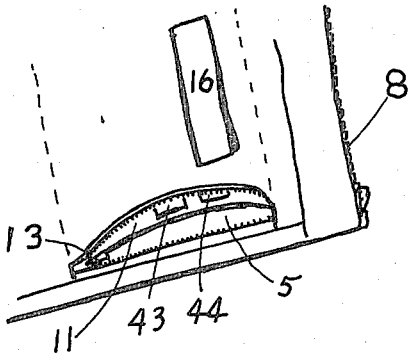
FIG. 11.
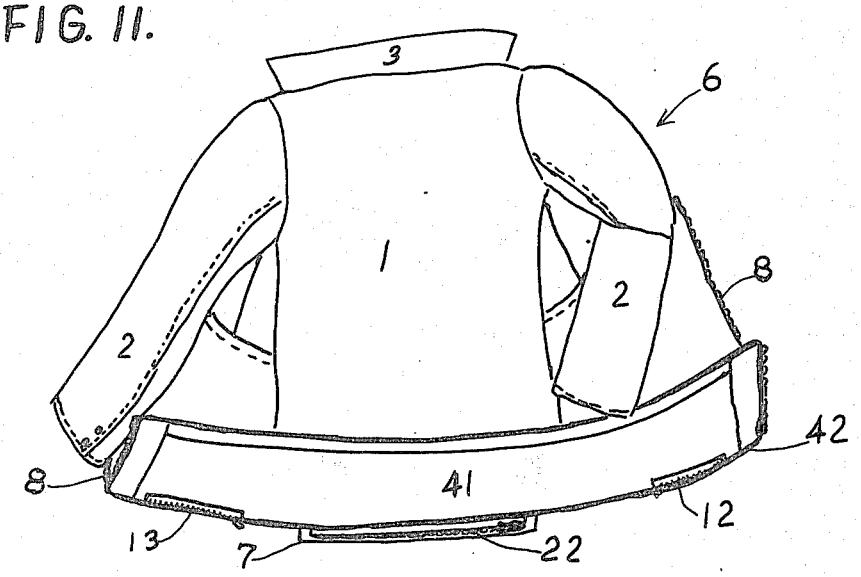

WEARABLE PURSE

BACKGROUND OF THE INVENTION

1. Field of the Invention

This invention relates to a dual purpose garment used both as a garment and a purse. It more particularly relates to a purse capable of being worn as an outer garment or converted and carried as a purse. Contained items are always accessible in either mode.

2. Description of the Prior Art

Heretofore, dual purpose articles of this type have been raincoats or jackets that folded or stuffed into a pocket or pouch for convenient carrying and storage. The primary purpose of the pocket or pouch was to transport the garment. Some of these bags or pouches functioned as tote bags while in the folded state, but the disadvantage of these is that when converted back to an outerwear garment there is no convenient storage area for items that were placed in the tote bag. Some of the tote bags are comprised of a portion of the outerwear garment. The disadvantage of these is that the garment portion is exposed to soiling.

SUMMARY OF THE INVENTION

Accordingly, it is an object of this invention to provide a dual purpose garment that functions as a purse at all times whether being worn as an outer garment or being carried as a purse.

Another object of this invention is to provide a garment with inner pockets which serve as a means of carrying articles usually carried in a purse and to arrange the pockets in such a manner that while wearing the garment the overall appearance of the garment is not distorted by the presence of the articles.

Another object of this invention is to provide a means for carrying items usually carried in a purse in such a manner that they are secure and not easily stolen while the garment is being worn, most of the pockets being in the lining portion of the garment and provided with closing devices to keep items secure.

Another object of the invention is to provide an attractive means for carrying the garment while it is not being worn, said means also protecting it from soiling.

Another object of this invention is to provide convenient access to all items carried in the garment while the garment is converted into a purse.

Further objects and advantages of this invention will become apparent from a consideration of the drawings and ensuing description thereof.

BRIEF DESCRIPTION OF THE DRAWINGS

FIG. 1 is a perspective front view of my invention in the form of an outer garment.

FIG. 2 is a perspective view of my invention folded to the form of a purse and illustrating all the zippers engaged.

FIG. 3 is a perspective view of the inside of my invention in opened out condition preparatory to forming the purse portion of the invention.

FIG. 4 is a perspective view of my invention illustrating the initial step of the method for folding the garment shown in FIG. 1.

FIG. 5 is a perspective view of my invention illustrating the second step of the method for folding the garment shown in FIG. 1.

FIG. 6 is a fragmentary perspective view of the method for fastening the sides of showing purse portion together.

FIG. 7 is a fragmentary perspective view of my invention with another embodiment wherein the purse strap is detachable.

FIG. 8 is a perspective view of another embodiment of the purse portion of my invention showing Velcro side closures and a draw string top closure.

FIG. 9 is a perspective view of the purse of FIG. 8 with the garment portion is folded into it.

FIG. 10 is a fragmentary perspective view of the inner portion of lower garment pockets illustrating accessibility for purse mode.

FIG. 11 is a perspective view of another embodiment of my invention illustrating an initial step in folding the garment if the garment is longer than the purse portion of the garment.

DESCRIPTION OF THE PREFERRED EMBODIMENTS

FIG. 1 illustrates the dual purpose purse as it appears when worn as an outer garment. Garment 6 consists of a trunk portion 1 including a central back panel and side panels to be worn on the upper part of the human body, sleeve portions 2, collar 3, pockets 4 and 5, all constructed and joined according to conventional garment making. Garment 6 also contains a lining 28, as further illustrated in FIG. 3. A purse portion or panel 7 is affixed to the back portion of lining 28. The purse portion 7 is stitched to lining 28 along line 26. When the purse portion 7 is stitched along line 26, gussets 19 are left loose. Top and bottom end of the purse portion 7 are loose approximately one inch to allow extension above top purse closing 22, more specifically shown in FIG. 2.

Lining 28 contains various pockets as follows: Two pockets 10 and 11 are placed in the lower front portion of lining 28, contained zipper closures 15 and 14 at the top respectively and zipper closures 12 and 13 at the bottom respectively. The bottom zipper closures 12 and 13 provide a means for entering pockets 10 and 11 when garment 6 is folded into a purse. Pockets 10 and 11 are of adequate depth to be used as a means of conveniently carrying such items as blank checks, travelers checks, an address book and passport. Pocket 11 also contains small inner pockets 43 and 44 illustrated in FIG. 10 that are a suitable means for carrying small items such as nail clippers and nail file. As shown, the small pockets 43 and 44 are accessible through the lower zipper closure 13, thus being accessible while garment 6 is being worn or when converted and carried as a purse.

As shown in FIG. 3, a pocket 17 is located just above pocket 10 and has a zipper closure 30. Pocket 17 is of sufficient depth and has been found to be a conveient means for carrying keys. A pocket 9 is located just above pocket 11 and has a top zipper closure 29. Zipper closure 29 is of sufficient length so as to be slighly longer than United States currency and pocket 9 has been found to be a very convenient and secure means for carrying currency and coins. It has been further found that when the currency and coins are contained within a removable wallet type carrier constructed to fit within pocket 9, more convenience is achieved.

A small patch type pocket 16 is affixed to the lower front portion of lining 28 and placed to fit between zipper closures 13 and 14. Pocket 16 is left open at both ends and is specifically designed as a means to carry a writing device equipped with a clip. It is possible to insert the writing device from either end of pocket 16, thus making the writing device accessible while the garment is in either mode.

Another pocket 18 is included as part of lining 28, this pocket being located on the extreme upper portion of front lining 28 just a few inches down from the shoulder seam. Pocket 18 has been found to be a convenient and protective means for carrying eye glasses. The eye glasses lie in the hollow portion of the human body just below the shoulder and toward the arm. Thus, when carried in pocket 18, the glasses are not visible while the garment is being worn, and do not distort the appearance of the garment. Pocket 18 is accessible when the garment is converted to a purse.

Another patch type pocket 31 is affixed to lining 28 a few inches down from the armhole and centered below the armhole. Pocket 31 is tapered and contains an expansion pleat and has been found to be a convenient means for carrying a small camera.

As illustrated in FIG. 1 the outside of garment 6 contains two pockets 4 on the upper front portion, one on either side. Pockets 4 are provided with a small strip of VELCRO near the top opening, such VELCRO being used as a means of closure to prevent items from falling out. Pockets 4 are of sufficient size and have been found to be a convenient means for carrying credit cards and driver's license. Pockets 4 are accessible when the garment is converted to a purse. Garment 6 also contains two lower pockets 5 located on the lower outer front portions of said garment. Pockets 5 are conventional pockets and may be used as any conventional garment pocket would be used. Pockets 5 are accessible through zipper closures 12 and 13 when the garment is converted to a purse, further illustrated in FIG. 10.

As shown in FIG. 3 the purse portion 7 of the garment 6 consists of a rectangular portion containing pocket 24 with a zipper closure 23, the pocket 24 being located slightly down from the top of the rectangular portion. Purse portion 7 may also contain another pocket 40 (further illustrated in FIG. 9) which may or may not include any type of closure device. Four gusset sections 19 are affixed to purse portion 7, these gusset sections being attached along the side of the rectangular piece slightly in from the ends of the rectangular piece and extending toward the center, but not coming together so as to leave a space between gussets 19 at the center along the sides of rectangular piece 7. In this space is placed a small stiffened somewhat square piece 25 containing a strip of VELCRO along one edge. This stiffened piece extends under the rectangular portion with only the VELCRO portion extending beyond edges of rectangular piece 7. The ends of the gussets 19 adjacent to this center piece also contain short strips of VELCRO 33 as shown in FIG 6. Gussets 19 also contain separating type zippers 20 affixed to the edges. Another separating type zipper 22 is affixed to each end of rectangular portion 7 shown in FIGS. 4 and 11.

A strap 21 shown in FIG. 3 is provided as a means for carrying the purse 7. This strip is attached to tabs of zippers 20. Buttons 27 are affixed to lining 28 near the highest position of zipper tabs 20 when the garment is being worn, specifically near one top corner of the purse portion 7 and just below the center of purse portion 7 adjacent to one of gussets 19. Buttonholes 32 shown in FIG. 6 are located on strap 21 near each end for attaching to buttons 27, thus providing a means for holding strap in place while garment is being worn. Buttons and buttonholes are shown in this illustration but it is to be understood that other means of fastening the strap 21 may be used.

As illustrated in FIG. 7 instead of using the strap 21 a detachable strap 35 may be equipped with hook type fasteners 34 at either end, said fasteners clipping to the hole in the zipper tabs when the garment is converted to a purse. While the garment is being worn, strap 35 may be carried on the lower back lining portion of the garment and supported by belt type loops 36, the strap passing through the center loops and the hook fasteners 34 clipping into the end loops, thus securing the strap 35 in place while the garment is being worn.

When it is desired to convert garment 6 to a purse 7 as shown in FIG. 2, the garment 6 is placed with the outside facing up as shown in FIG. 4. Collar 3 is folded down onto the back. Strap 21 is unfastened from lining 28. The bottom portion of each sleeve 2 is folded up and each garment front portion is folded back onto the back portion, thus folding the jacket somewhat into thirds as shown in FIG. 5 and being contained within the size of the rectangular conventional purse portion 7. Rectangular purse portion 7 is then folded half way between its top and bottom enclosing garment portion 6. FIG. 6 illustrates how piece 25 is folded up and gussets 19 fastened to piece 25 by means of the VELCRO affixed to piece 25 and VELCRO pieces 33 on gussets 19. Zippers 20 are then engaged, thus forming a purse as shown in FIG. 2 that consists of two sides, two ends (gussets), a flat bottom portion and a strap for carrying the purse. Lastly zipper 22 is engaged thus providing a means for closing the top of the purse. Once converted to a purse, it bears no resemblance to the wearable garment. All outer garment surfaces are contained within the purse and are thus protected against soiling. It is further noted that when garment 6 is folded as described above and carried within purse portion 7, garment 6 remains in this neatly folded state and remains somewhat wrinkle free. It is further noted that all pockets contained in the garment, with the exception of pockets 9 and 17, are still accessible while the garment is converted to a purse. It is further suggested that items from pockets 9 and 17 may be transferred to pocket 24 on the outside of the purse at the time the garment is converted to a purse.

Another embodiment of garment 6 as shown in FIG. 8 demonstrates that instead of zippers on gussets 19, VELCRO 39 may be used as a means for closing sides of a purse portion 7. It is further shown that a different method of closing the top of the purse can be obtained by making the purse portion 7 a little longer and allowing a portion at each end to fold back on itself, the portion 7 containing a casing 37 with two continuous drawstrings 38 inserted so as to continue through both upper and lower casings and, being of sufficient length to hold the extended purse ends in place while garment is being worn. When the garment is converted to a purse the draw strings are pulled, causing the top of the purse to be closed as in FIG. 9.

Another embodiment of garment 6 as shown in FIG. 11 illustrates that the garment may be made longer than shown in FIG. 1. When garment is converted to a purse the extra length 41 is first folded back onto the outside of garment 6 and then the garment is folded as illustrated in FIGS. 4 and 5. The purpose of this initial folding step is to cause zippers 12 and 13 to be at the fold line 42 and make them accessible when the garment is converted to a purse. It is further noted that zipper closures 12 and 13 should be somewhat aligned with the bottom of rectangular purse portion 7 causing closures 12 and 13 to be accessible through top conventional purse zipper closure 22 when the garment is converted to the purse mode.

Garment 6 and purse 7 may be made of any conventional material such as polyester, nylon, cotton, wool or a blend of such types of materials. For most satisfactory results the material should be relatively light in weight and should not be prone to wrinkling when folded. It has been found that the synthetic suede materials are especially suited for this purpose.

While the above description contains many specifications, these should not be construed as limitations on the scope of the invention, but rather as an exemplification of preferred embodiments thereof. Many other variations are possible, for example; the purse portion may be designed in various ways with different arrangements of outside pockets or differently shaped gussets. The purse portion could consist of a bag or pouch affixed to the back lining of the garment. The inner pockets of the garment may be arranged in various ways, more pockets added or some eliminated. The function of the pockets can vary. The outside of the garment may be designed in many different ways. Accordingly, the scope of the invention should be determined, not by the embodiments illustrated but by the appended claims and their legal equivalents.

What is claimed is:

1. A garment convertible to a carrying purse and vice versa comprising:

a flexible body member comprising at least three panels having upper and lower portions and inner and outer surfaces, said panels in garment form consisting of a central back panel and a panel joined to said back panel on each side thereof arranged to be worn as a garment and to be folded outwardly in overlapping relation, a purse panel secured to the inner surface of said back panel and having an intermediate foldable area arranged to form the sides of a purse and enclose portions of said panels when said purse panel is folded at said foldable area, and means on each side of said purse panel including releasable fastening means cooperating to form end walls of a purse when said purse panel is folded at said foldable area.

2. The garment of claim 1 including a rigid strip adjacent said foldable area forming a bottom wall of the purse when folded.

3. The garment of claim 1 including a rigid strip adjacent said foldable area forming a bottom wall of the purse when folded, and VELCRO means cooperating between said strip and said sides for converting said garment to a purse and vice versa.

4. The garment of claim 1 wherein said purse panel contains at least one pocket with a zipper closing.

5. The garment of claim 1 including a pocket in the lower inside portion of one of said side panels in the same proximity as a pocket in the lower outside portion of the same panel, said pockets having an open slit along the bottom between them and also having a zipper closure at the lower portion of the said one panel, thereby providing a means of access to both of said pockets.

6. The garment of claim 1 including an elongated pocket in said body member situated so as to provide a means for carrying and protecting eyeglasses, said pocket being accessible in both the garment and purse forms.

7. The garment of claim 1 including a small rectangular patch-type pocket affixed to a lower portion of said body member lining, said pocket being of suitable size for receiving a writing device with a clip, said pocket being open at both ends and arranged such that a writing device may be inserted from either end in both the garment and purse forms.

8. The garment of claim 1 further including a patch-type pocket with a pleated bottom affixed to a side portion of said body member, said pocket being of sufficient size to provide a means of carrying a small camera, said pocket being accessible in both the garment and purse forms.

9. The garment of claim 1 including pockets on the upper outside portion of said body member, said pockets being of sufficient size to serve as a means for carrying credit cards and driver's license, said pockets containing a closing device and being accessible in both the garment and purse forms.

10. The garment of claim 1 wherein said fastening means includes zippers, and hook means arranged to attach to said zippers so that said strap is detachable.

* * * * *